US006161227A

United States Patent [19]

Bargenquast

[11] Patent Number: 6,161,227

[45] Date of Patent: Dec. 19, 2000

[54] PORTABLE HAND CLEANING DEVICE

[76] Inventor: Scott Bargenquast, 5068 Meta Dr., Nashville, Tenn. 37211

[21] Appl. No.: 09/375,870

[22] Filed: Aug. 17, 1999

[51] Int. Cl.[7] ..... A47K 3/022

[52] U.S. Cl. ..... 4/622; 4/623; 134/95; 134/95.2; 134/58 R; 15/21 R

[58] Field of Search ..... 4/619, 621, 622, 4/623, 625, 626; 134/95.2, 95.3, 58 R; 607/81, 86

[56] References Cited

U.S. PATENT DOCUMENTS

| | | | |
|---|---|---|---|
| 3,918,117 | 11/1975 | Plante | 15/21 R |
| 3,918,987 | 11/1975 | Kopfer | 134/95 |
| 3,943,951 | 3/1976 | Spotz . | |
| 4,020,856 | 5/1977 | Masterson . | |
| 4,137,929 | 2/1979 | Grossman . | |
| 4,295,233 | 10/1981 | Hinkel et al. . | |
| 4,402,331 | 9/1983 | Taldo et al. | 134/58 R |
| 4,564,968 | 1/1986 | Buckley | 15/21 R |
| 4,722,372 | 2/1988 | Hoffman et al. | 4/623 |
| 4,742,836 | 5/1988 | Buehler . | |
| 4,817,651 | 4/1989 | Crisp et al. . | |
| 5,199,118 | 4/1993 | Cole et al. . | |
| 5,265,628 | 11/1993 | Sage et al. | 134/58 R |
| 5,522,411 | 6/1996 | Johnson . | |
| 5,670,945 | 9/1997 | Applonie . | |
| 5,727,579 | 3/1998 | Chardack | 134/95.2 |
| 5,863,497 | 1/1999 | Dirksing | 422/28 |
| 5,924,148 | 7/1999 | Flowers, Sr. | 4/623 |

FOREIGN PATENT DOCUMENTS

| | | | |
|---|---|---|---|
| 229203 | 7/1987 | European Pat. Off. | 4/621 |

*Primary Examiner*—Henry J Recla
*Assistant Examiner*—Khoa D. Huynh
*Attorney, Agent, or Firm*—Alvin R. Wirthlin; Akin, Gump, Strauss, Hauer & Feld, L.L.P.

[57] ABSTRACT

A hand cleaning device includes a housing having an inner cleaning compartment. A pair of access openings are formed in the housing and communicate with a pair of cleaning chambers within the cleaning compartment. A reservoir is provided in the housing below the cleaning compartment for storing a supply of cleaning fluid. A plurality of nozzles are positioned in each cleaning chamber for directing cleaning fluid toward the hands of a user when inserted through the access openings. A pump is fluidly connected between the reservoir and the nozzles for transferring cleaning fluid from the reservoir to the nozzles. A power supply is connected to the pump and a switch is located within the housing between the power supply and the pump. The switch is operable to actuate the pump when a user's hand is positioned in the cleaning compartment. The switch may be manually actuable or may automatically sense the presence of a hand in the cleaning compartment.

25 Claims, 5 Drawing Sheets

PORTABLE HAND CLEANING DEVICE

BACKGROUND OF THE INVENTION

1. Field of the Invention

This invention relates to human hygiene, and more particularly to a portable hand cleaning device that can be installed in areas where water and electricity are normally unavailable.

2. Description of the Related Art

Portable human waste management facilities, or outhouses, are often installed at construction sights, community events, and so on. Such facilities ordinarily are not located near a convenient source of water or electricity, and are therefore not provided with a means to wash the hands after use. The absence of hand washing means contributes to a hygienically unsafe environment and its accompanying health hazards.

U.S. Pat. No. 5,522,411 discloses a portable hand washing and drying device comprising a middle compartment for receiving the hands of a user; an upper compartment with a blower for drying the hands, a battery for powering the blower, a cleaning liquid reservoir, and a lower compartment for receiving used cleaning liquid. In order to clean the hands, one hand is placed in the middle compartment while the other hand opens a valve to thereby cause the cleaning fluid to flow from the upper compartment into the middle compartment and onto the user's hand under gravity. The other hand then closes the valve and is placed in the middle compartment and the hands are rubbed together. Used cleaning fluid then falls into the lower compartment. One of the hands is then removed from the middle compartment to turn on the drying fan and then re-inserted into the compartment in order to dry the hands.

Although this device may adequately clean and dry the hands, the cleaning and drying process is relatively inefficient due to the number of required operational steps combined with the actual cleaning and drying time. Consequently, a person is less apt to take full advantage of such a device.

SUMMARY OF THE INVENTION

It is therefore an object of the present invention to provide a hand cleaning device that cleans the hands in a relatively efficient manner.

It is another object of the invention to provide a portable hand cleaning device that can be installed at locations where water and electricity are normally unavailable.

According to the invention, a hand cleaning device includes a housing having an inner cleaning compartment. At least one access opening is formed in the housing and communicates with the cleaning compartment. The at least one opening is sized to receive a user's hand. A reservoir is provided for storing a supply of cleaning fluid. At least one nozzle is positioned in the housing for directing cleaning fluid toward the user's hand. A pump is fluidly connected between the reservoir and the at least one nozzle for transferring cleaning fluid from the reservoir to the nozzle. A power supply is connected to the pump for operating the pump. A switch is located within the housing and is electrically connected between the power supply and the pump. The switch is operable to actuate the pump when a user's hand is positioned in the cleaning compartment.

Preferably, the switch is located in the cleaning compartment. In one embodiment, the switch is manually operable by the user. In another embodiment, the switch includes a proximity sensor located within the cleaning compartment for determining the presence of a hand within the cleaning compartment.

According to an even further embodiment of the invention, a hand cleaning device includes a housing with an inner cleaning compartment having first and second cleaning chambers. First and second access openings are formed in the housing and communicate with the first and second cleaning chambers, respectively. Each access opening is sized to receive a user's hand. A reservoir is provided for storing a supply of cleaning fluid. A plurality of nozzles are positioned in each cleaning chamber for directing cleaning fluid toward the user's hands. A pump is fluidly connected between the reservoir and the plurality of nozzles and a power supply is connected to the pump for operating the pump to thereby transfer cleaning fluid from the reservoir to the nozzles.

In one embodiment, the plurality of nozzles comprises a pair of nozzles positioned in each cleaning chamber. The nozzles of each pair of nozzles are oriented in opposing relationship such that a tip of each nozzle is directed toward a centerline of its respective access opening.

In a further embodiment, the plurality of nozzles comprises three nozzles positioned in each cleaning chamber. The three nozzles in each cleaning chamber are oriented at approximately 120° intervals around an imaginary centerline passing through its respective access opening, with a tip of each nozzle directed radially toward its respective centerline.

In yet a further embodiment, the plurality of nozzles comprises four nozzles positioned in each cleaning chamber. The four nozzles in each cleaning chamber are oriented at approximately 90° intervals around an imaginary centerline passing through its respective access opening, with a tip of each nozzle directed radially toward its respective centerline.

Other objects, features and advantages of the invention will become apparent upon a review of the following detailed description of the invention and the appended claims, together with the accompanying drawings.

BRIEF DESCRIPTION OF THE DRAWINGS

The preferred embodiments of the present invention will hereinafter be described in conjunction with the accompanying drawings, wherein like designations denote like elements throughout the drawings, and wherein.

It is noted that the drawings of the invention are not necessarily to scale. The drawings are merely schematic representations and thus are not intended to portray specific parameters of the invention. The drawings are intended to depict only typical embodiments of the hand cleaning device, and therefore should not be considered as limiting the scope of the invention. The hand cleaning device will now be described with additional specificity and detail through the accompanying drawings.

DETAILED DESCRIPTION OF THE PREFERRED EMBODIMENTS

Figure 1:
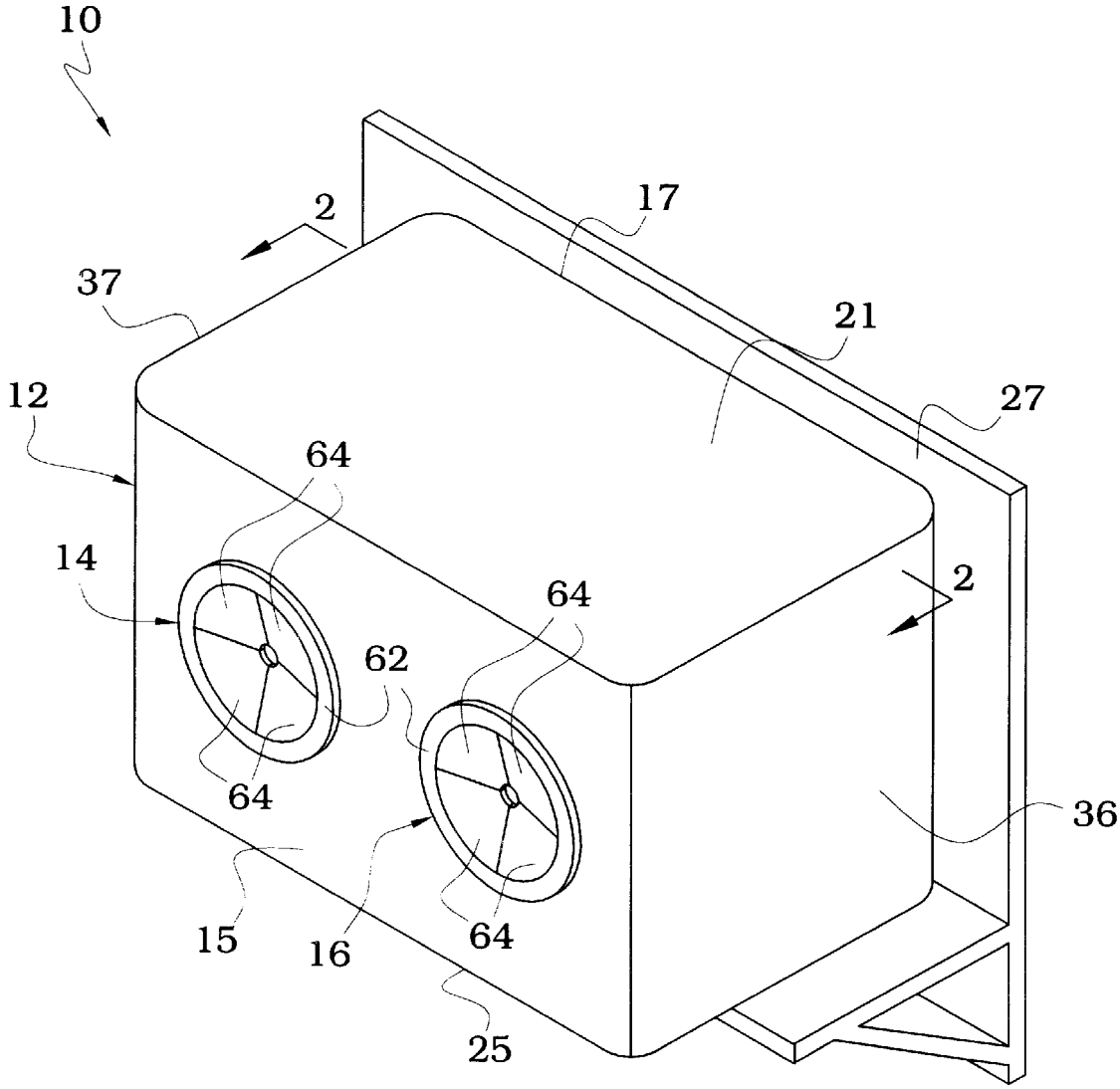
FIG. 1 is an orthographic view of a hand cleaning device according to the present invention.
Figure 2:
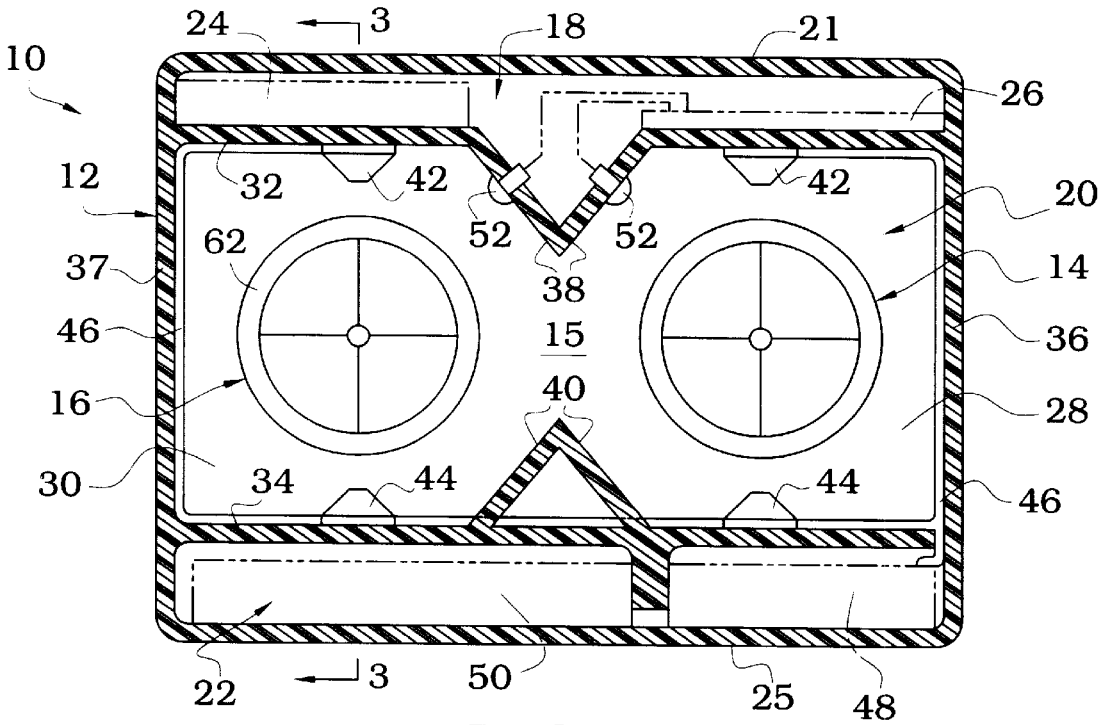
FIG. 2 shows a cross-section of the hand cleaning device taken along line 2—2 of FIG. 1.
Figure 3:
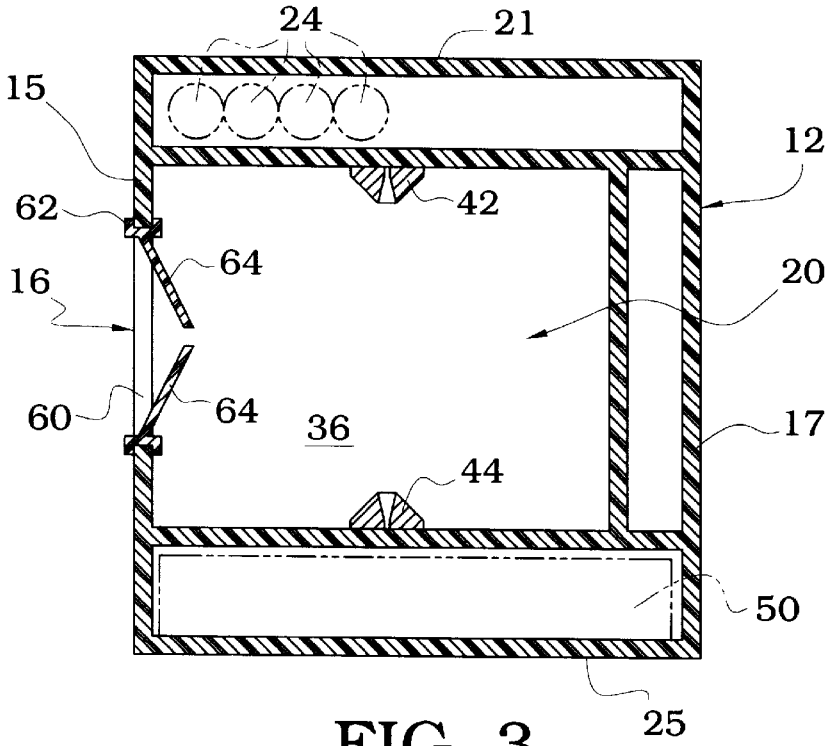
FIG. 3 is a cross-sectional view of the hand cleaning device taken along line 3—3 of FIG. 2.

Referring now to the drawings, and to FIGS. 1 to 3 in particular, a hand cleaning device 10 according to the invention is illustrated. The hand cleaning device 10 includes a housing 12 with a pair of access ports 14 and 16 through which the hands of a user can be inserted. The housing includes a front wall 15 connected to a rear wall 17 through a pair of side walls 36, 37, and upper and lower walls 21 and 25, respectively. The housing 12 is divided into an upper electronics compartment 18, a middle cleaning compartment 20, and a lower fluid supply compartment 22. The hand cleaning device 10 may be mounted on a bracket or shelf 27, which in turn may be mounted to a wall or other support structure. Alternatively, the device 10 may be directly mounted to a support structure.

The upper compartment 18 includes an electrical power source 24 (shown in phantom line), and electronic circuitry 26 (also shown in phantom line) for operating the hand cleaning device 10, as will be described in greater detail below. The power source preferably includes one or more batteries to thereby permit operation of the hand cleaning device 10 in environments where electricity is normally unavailable or is otherwise difficult to obtain. Alternatively, the power source may be in the form of AC line power, converted DC line power, or the like. Access to the upper compartment 18 may be provided by a door, drawer, or other access means (not shown) associated with the upper compartment.

The middle compartment 20 is divided into a first inner chamber 28 and a second inner chamber 30. The access port 14 opens into the first inner chamber 28 while the access port 16 opens into the second inner chamber 30. Each of the inner chambers are defined by an upper dividing wall 32, a lower dividing wall 34, the outer side wall 36 or 37, and inner side wall portions 38, 40. An upper nozzle 42 is mounted to the upper dividing wall 32 while a lower nozzle 44 is mounted to the lower dividing wall 34 in each chamber. The nozzles are preferably of the atomizer type, i.e. they are shaped to spray a relatively fine mist of cleaning solution onto the hands of a user when inserted into the inner chambers 28 and 30. Preferably, the nozzles are oriented at diametrically opposite sides of the access ports 14 so that the upper and lower portions of the hands are simultaneously exposed to the spray. A conduit 46 extends between the nozzles 42, 44 and a fluid pump 48 (shown in phantom line) located within the fluid supply compartment 22. The fluid pump is in turn fluidly connected to a reservoir 50 (also shown in phantom line) that holds a quantity of cleaning fluid. In this manner, cleaning fluid is transferred from the reservoir 50 to the nozzles 42, 44 during operation of the hand cleaning device.

Preferably, the cleaning fluid is of the anti-bacterial type that has a relatively quick evaporation rate. Although many different types of cleaning fluids may be used with the present invention, alcohol-based formulations are preferable due to their germ killing properties and relatively quick evaporation rate. With the combination of the fine misting nozzles and quick evaporation rate of the cleaning solution, a fluid recovery tank is normally not needed. Consequently, the reservoir 50 can occupy more of the space normally reserved for a recovery tank to thereby accommodate a greater volume of cleaning solution, which in turn increases the time interval between refills.

A proximity sensor 52 is located in each of the first and second hand cleaning chambers for detecting the presence of a hand within one or both chambers for actuating the fluid pump 48, as will be described in greater detail below with reference to FIG. 8. The proximity sensor 52 may be of the type that senses the presence or absence of energy in the electromagnetic spectrum. For example, the sensor 52 may be of the infrared type that senses body heat. Alternatively, the sensor 52 may include a light source, such as an LED of the visible or infrared type, and a compatible light detector spaced from the emitter at a location within one or both cleaning chambers such that radiant energy emitted from the light source is blocked from reaching the detector when the hand or other object is present in the chamber. Other suitable proximity sensors may be of the ultrasonic type, or any other contactless-type switch or device. Although a proximity sensor is preferred, a manual switch may be provided in the hand-cleaning compartment 20 for actuating the fluid pump by hand once one or both hands are inserted into their respective chambers. Alternatively, the switch may simply be a limit switch that is actuated when brushed by the hand as it passes through one of the access ports.

Each access port 14, 16, includes an opening 60 formed in the front wall 15 of the housing 12 and a door 62 positioned in the opening. The door 62 includes a plurality of flaps 64 constructed of a flexible material. The flaps normally prevent the ingress of dust and other foreign matter into the hand-cleaning compartment 20 when the hand cleaning device 10 is not in use. During use, the flaps normally prevent the escape of cleaning solution by creating somewhat of a seal around a user's forearms.

In use, the hands of a user are inserted into the access ports 14, 16. The proximity sensor 52 senses the presence of one or more of the hands in the cleaning compartment 20 and actuates the pump 48. The pump in turn transfers cleaning fluid from the reservoir 50 to the nozzles 42 and 44 under pressure. Since the nozzles are of the atomizer type, a fine spray of cleaning fluid is coated on the hands. The quick evaporative rate of the cleaning fluid in the atomized state eliminates the need for a separate drying mechanism and recovery tank as is required in the prior art. Once coated, the hands are removed from the cleaning chamber and may be rubbed together to enhance the cleaning and drying effect.

Figure 4:
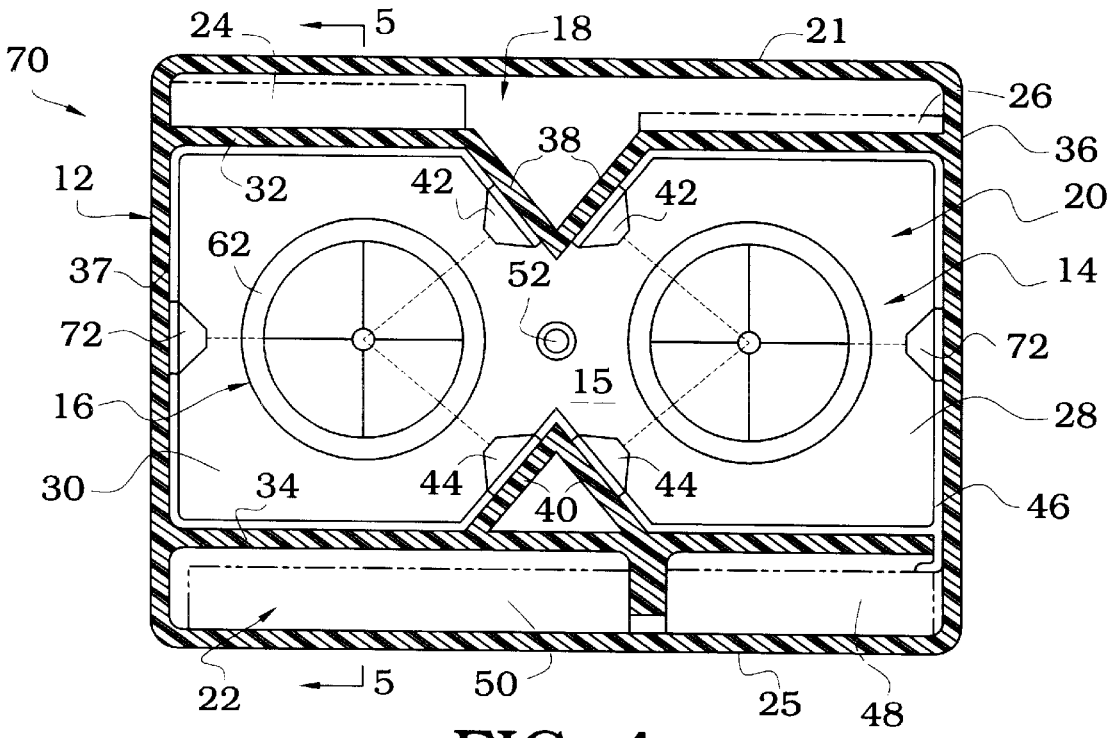
FIG. 4 is a cross-sectional view similar to FIG. 2 of a hand cleaning device according to a second embodiment of the invention.
Figure 5:
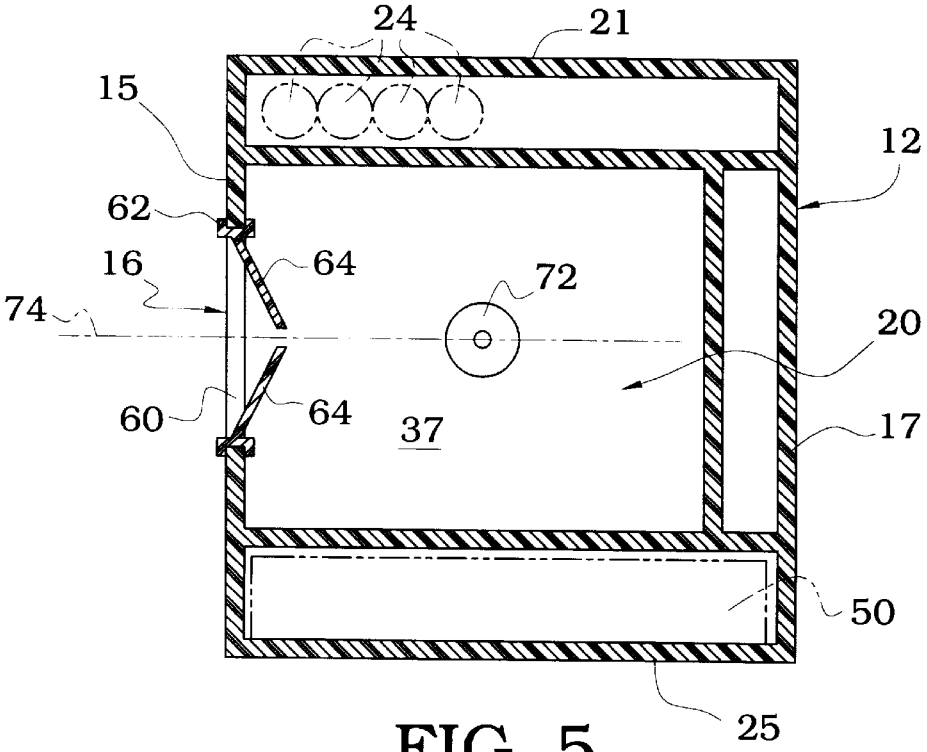
FIG. 5 is a cross-sectional view of the hand cleaning device taken along line 5—5 of FIG. 4.

With reference now to FIGS. 4 and 5, a hand cleaning device 70 according to a further embodiment of the invention is illustrated, wherein like parts in the previous embodiment are represented by like numerals. In this embodiment, three nozzles 42, 44, and 72 are located in each of the inner chambers 28, 30. The upper and lower nozzles are mounted to the inner side wall portions 38 and 40, respectively, while the third nozzle 72 is mounted to the outer side wall 36 or 37. Preferably, the nozzles are spaced at 120° intervals around an imaginary centerline 74 passing through the opening 60, with the tip of each nozzle directed radially toward the centerline. In this manner, each hand of a user receives the cleaning solution in a relatively fine mist simultaneously from three locations.

A proximity sensor 52 is located between the first and second hand-cleaning chambers for detecting the presence of a hand within one or both chambers for actuating the fluid pump 48. The proximity sensor 52 may be any of the types previously described, or may be a manual switch for actuating the fluid pump once one or both hands are inserted into their respective chambers.

Figure 6:
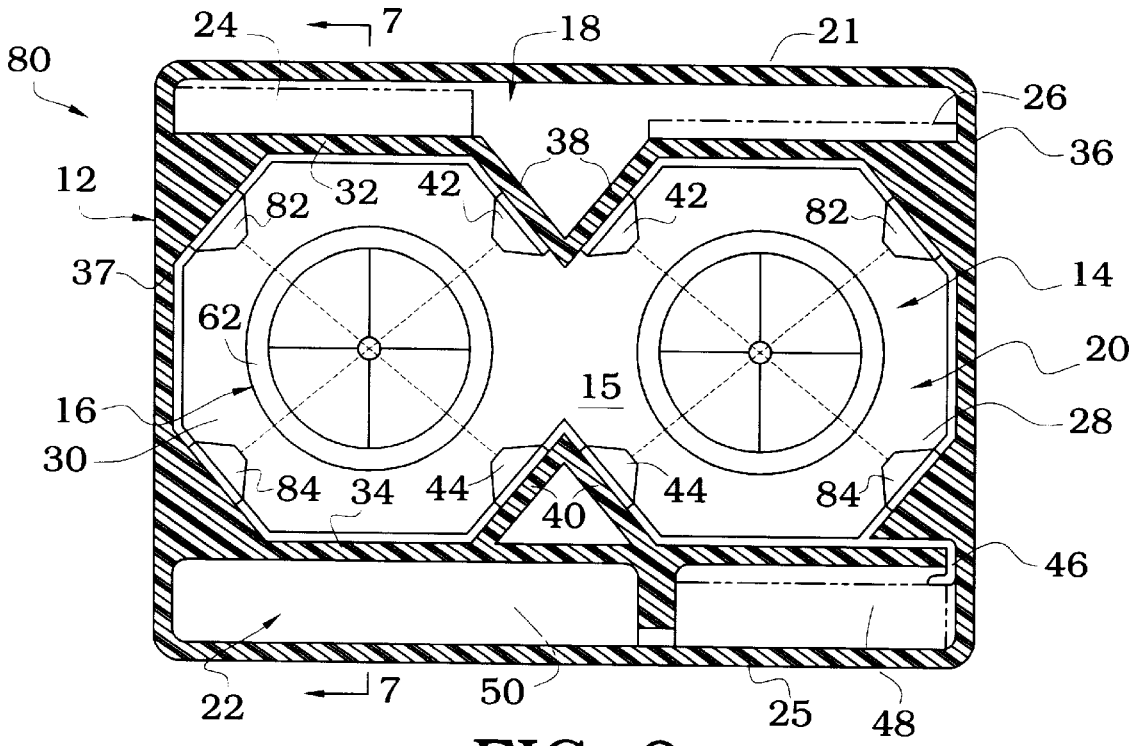
FIG. 6 is a cross-sectional view similar to FIG. 2 of a hand cleaning device according to a third embodiment of the invention.
Figure 7:
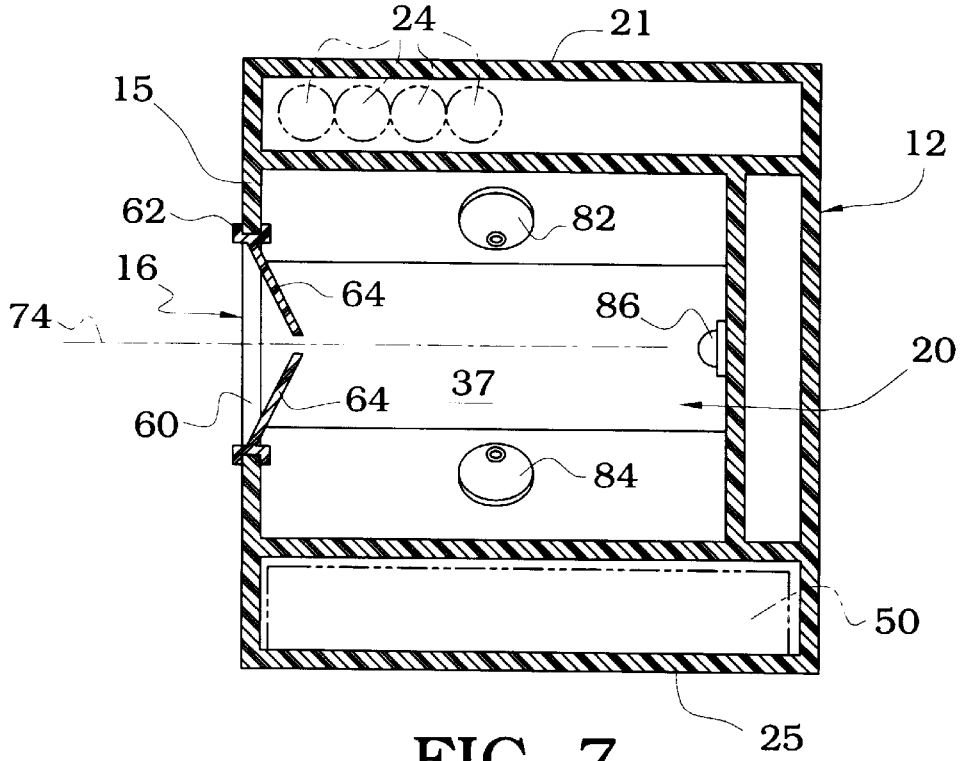
FIG. 7 is a cross-sectional view of the hand cleaning device taken along line 7—7 of FIG. 6.

With reference now to FIGS. 6 and 7, a hand cleaning device 80 according to an even further embodiment of the invention is illustrated, wherein like parts in the previous embodiments are represented by like numerals. In this embodiment, a pair of upper nozzles 42, 82 and a pair of lower nozzles 44, 84 are located in each of the inner chambers 28, 30. The upper and lower nozzles 42 and 44 are mounted to the inner side wall portions 38 and 40, respectively, while the upper and lower nozzles 82 and 84 are mounted to the outer side wall 36 or 37. Preferably, the nozzles are spaced at 90° intervals around the imaginary centerline 74 passing through the opening 60, with the tip of each nozzle directed radially toward the centerline. In this manner, each hand of a user receives the cleaning solution in a relatively fine mist simultaneously from four locations.

A push-button type manual switch 86 is located in the cleaning compartment 20 between the first and second hand-cleaning chambers (or at any other convenient location within the compartment 20) for actuating the fluid pump 48 when pressed by a user. Alternatively, a contactless switch, limit switch, or other means for actuating the fluid pump 48 may be located in the compartment 20.

Figure 8:
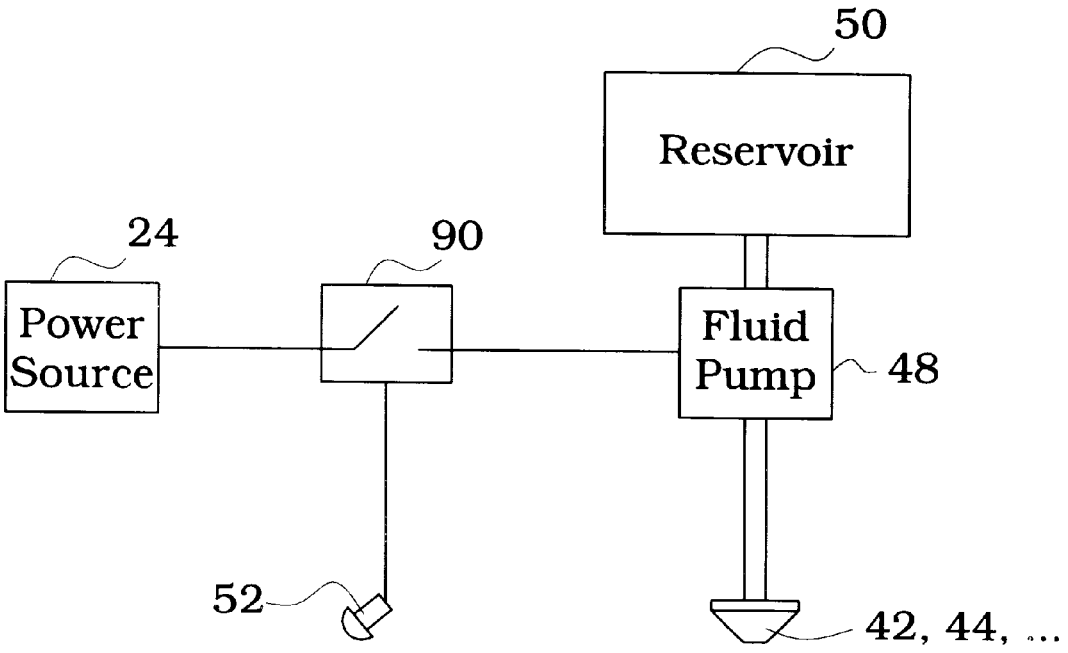
FIG. 8 is a schematic diagram of the working components of the present invention.

With reference now to FIG. 8, a schematic diagram of the working components of the present invention for each of the above embodiments is illustrated. As shown, an electrical switching device 90, such as a relay and its associated operational circuitry, or the like, is electrically positioned between the power source 24 and the fluid pump 48. The switching device 90 is also connected to the proximity sensor 52. In use, the switching device 90 is normally open so that the flow of electricity from the power source to the fluid pump 48 is cut off. When the proximity sensor 52 detects the presence of a hand within the cleaning compartment 20, the switching device 90 is closed to thereby actuate the fluid pump 48. The switching device preferably remains closed until the hand is withdrawn from the compartment 20. Alternatively, the switching device 90 may be operably associated with a timer for actuating the pump 48 over a predetermined time period.

When a manual switch is used, such as the push-button switch 86, the switching device 90 and proximity sensor may be eliminated.

While the invention has been taught with specific reference to the above embodiments, those skilled in the art will recognize that changes can be made in form and detail without departing from the spirit and the scope of the invention. For example, although the first and second chambers in each of the above embodiments are in fluid communication with each other, they may be formed as separate chambers, e.g. an inner wall may extend between the chambers. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The embodiments for which an exclusive property or priviledge is claimed are defined as follows:

1. A hand cleaning device, comprising:

a housing including an inner cleaning compartment with an upper side wall portion and a lower side wall portion spaced from the upper side wall portion, the upper and lower side wall portions dividing the inner cleaning compartment into first and second cleaning chambers, the first and second cleaning chambers being in fluid communication with each other in the space between the upper and lower side wall portions;

first and second access openings formed in the housing and communicating with the first and second cleaning chambers, respectively, each of the access openings being sized to receive a user's hand;

a reservoir for storing a supply of cleaning fluid;

at least one nozzle positioned in each of the cleaning chambers for directing cleaning fluid toward the user's hand;

a pump fluidly connected between the reservoir and the nozzles for transferring cleaning fluid from the reservoir to the nozzles under pressure;

a power supply connected to the pump for operating the pump; and a switch electrically connected between the power supply and the pump, the switch being operable to actuate the pump when a user's hand is positioned in one of the cleaning chambers.

2. A hand cleaning device according to claim 1, wherein the switch is located in the cleaning compartment and is manually operable by the user.

3. A hand cleaning device according to claim 2, wherein the switch is located in the space between the upper and lower side walls portions.

4. A hand cleaning device according to claim 1, wherein the switch includes at least one proximity sensor located within the cleaning compartment for determining the presence of a hand within the cleaning compartment.

5. A hand cleaning device according to claim 4, wherein the proximity sensor is located in the space between the upper and lower side wall portions.

6. A hand cleaning device according to claim 4, wherein the at least one proximity sensor comprises a proximity sensor located in each cleaning chamber for detecting the presence of a hand within at least one of the cleaning chambers.

7. A hand cleaning device according to claim 1, wherein the at least one nozzle comprises a plurality of nozzles positioned in each cleaning chamber.

8. A hand cleaning device according to claim 1, wherein the at least one nozzle comprises a pair of nozzles positioned in each cleaning chamber, the nozzles of each pair of nozzles being oriented in opposing relationship such that a tip of each nozzle is directed toward a centerline of its respective access opening.

9. A hand cleaning device according to claim 1, wherein the at least one nozzle comprises three nozzles positioned in each cleaning chamber, the three nozzles in each cleaning chamber oriented at approximately 120° intervals around an imaginary centerline passing through its respective access opening, with a tip of each nozzle directed radially toward its respective centerline.

10. A hand cleaning device according to claim 9, wherein at least one of the nozzles in each cleaning chamber is located on at least one of the upper and lower side wall portions.

11. A hand cleaning device according to claim 10, wherein two of the nozzles in each cleaning chamber are located on the upper and lower side wall portions.

12. A hand cleaning device according to claim 9, wherein the nozzles in each cleaning chamber are located in a plane transverse to their respective imaginary centerline.

13. A hand cleaning device according to claim 1, wherein the at least one nozzle comprises four nozzles positioned in each cleaning chamber, the four nozzles in each cleaning chamber being oriented at approximately 90° intervals around an imaginary centerline passing through its respective access opening, with a tip of each nozzle directed radially toward its respective centerline.

14. A hand cleaning device according to claim 13, wherein two of the nozzles in each cleaning chamber are located on the upper and lower side wall portions.

15. A hand cleaning device according to claim 13, wherein the nozzles in each cleaning chamber are located in a plane transverse to their respective imaginary centerline.

16. A hand cleaning device according to claim 1, wherein the at least one nozzle is an atomizer nozzle for spraying a relatively fine mist of cleaning solution onto a user's hand.

17. A hand cleaning device according to claim 16, wherein the cleaning fluid has a relatively quick evaporation rate.

18. A hand cleaning device according to claim 1, and further comprising a door with a plurality of flexible flaps mounted in each access opening for preventing the escape of cleaning fluid out of the cleaning compartment.

19. A hand cleaning device, comprising:

a housing including an inner cleaning compartment having an upper side wall portion and a lower side wall portion spaced from the upper side wall portion, the upper and lower side wall portions dividing the inner cleaning compartment into first and second cleaning chambers, the first and second cleaning chambers being in fluid communication with each other in the space between the upper and lower side wall portions;

first and second access openings formed in the housing and communicating with the first and second cleaning chambers, respectively, each access opening being sized to receive a user's hand;

a reservoir for storing a supply of cleaning fluid;

at least one nozzle positioned in each cleaning chamber for directing cleaning fluid toward the user's hand;

a pump fluidly connected between the reservoir and the nozzles; and a power supply connected to the pump for operating the pump to thereby transfer cleaning fluid from the reservoir to the nozzles under pressure.

20. A hand cleaning device according to claim 19, wherein the plurality of nozzles comprises a pair of nozzles positioned in each cleaning chamber, the nozzles of each pair of nozzles being oriented in opposing relationship such that a tip of each nozzle is directed toward a centerline of its respective access opening.

21. A hand cleaning device according to claim 19, wherein the plurality of nozzles comprises three nozzles positioned in each cleaning chamber, the three nozzles in each cleaning chamber being oriented at approximately 120° intervals around an imaginary centerline passing through its respective access opening, with a tip of each nozzle directed radially toward its respective centerline.

22. A hand cleaning device according to claim 19, wherein the plurality of nozzles comprises four nozzles positioned in each cleaning chamber, the four nozzles in each cleaning chamber being oriented at approximately 90° intervals around an imaginary centerline passing through its respective access opening, with a tip of each nozzle directed radially toward its respective centerline.

23. A hand cleaning device according to claim 19, and further comprising a proximity switch located within the cleaning compartment for actuating the pump only when a user's hand is positioned in one of the cleaning chambers.

24. A hand cleaning device according to claim 19, wherein the plurality of nozzles are atomizer nozzles for spraying a relatively fine mist of cleaning solution onto a user's hand.

25. A hand cleaning device according to claim 24, wherein the cleaning fluid has a relatively quick evaporation rate.

* * * * *